United States Patent [19]

O'Connor

[11] Patent Number: 4,912,283

[45] Date of Patent: Mar. 27, 1990

[54] SHIELDING TAPE FOR TELECOMMUNICATIONS CABLES AND A CABLE INCLUDING SAME

[75] Inventor: Lawrence J. O'Connor, Winnipeg, Canada

[73] Assignee: KT Technologies Inc., Bridgetown, Barbados

[21] Appl. No.: 279,117

[22] Filed: Dec. 2, 1988

[30] Foreign Application Priority Data

Jan. 5, 1988 [GB] United Kingdom ..... 8800079

[51] Int. Cl.[4] ..... H01B 7/34

[52] U.S. Cl. ..... 174/36; 174/105 R; 428/458; 428/461

[58] Field of Search ..... 174/36, 105 R, 107; 428/458, 461

[56] References Cited

U.S. PATENT DOCUMENTS

| | | | |
|---|---|---|---|
| 3,848,073 | 11/1974 | Simons et al. | 174/36 |
| 3,968,321 | 7/1976 | Olszewski et al. | 174/36 |
| 4,117,260 | 9/1978 | Wilkenloh | 174/106 R |
| 4,323,721 | 4/1982 | Kincaid et al. | 174/36 |
| 4,327,246 | 4/1982 | Kincaid | 174/36 |
| 4,406,914 | 9/1983 | Kincaid | 174/107 |
| 4,477,693 | 1/1984 | Krabee et al. | 174/36 |
| 4,621,777 | 11/1986 | O'Connor | 174/36 X |
| 4,737,598 | 4/1988 | O'Connor | 174/36 |

FOREIGN PATENT DOCUMENTS

| | | | |
|---|---|---|---|
| 2526138 | 12/1976 | Fed. Rep. of Germany | 174/105 R |
| 2726168 | 12/1978 | Fed. Rep. of Germany | 174/107 |

*Primary Examiner*—Morris H. Nimmo

*Attorney, Agent, or Firm*—Adrain D. Battison; Stanley G. Ade; Murray E. Thrift

[57] ABSTRACT

A shielding tape particularly designed for CATV cable in which a single conductor is surrounded by insulation which is in turn wrapped by the tape comprises a laminate base tape of a conducting foil and a non-conducting plastic film. The base tape is folded along two fold lines spaced by slightly less than half the width of the base tape with the foil outermost at each of the folds and the edges of the base tape overlapping. A bonding layer can be applied on the side of the folded tape with the overlapping edges. An additional narrow J-fold can be applied along one edge to provide additional contact between the foil at the overlap. The continuous extent of the foil around the full periphery of the tape provides an improved "slot free" shielding effect.

14 Claims, 2 Drawing Sheets

SHIELDING TAPE FOR TELECOMMUNICATIONS CABLES AND A CABLE INCLUDING SAME

BACKGROUND OF THE INvENTION

This invention relates to shielding tapes or use in telecommuication and/or television shielded cables.

Telecommunications cables as referred to herein are of the type including one or more insulated conductors which are designed to transmit low power, high frequency signals.

Cables for CATV uses generally comprise a single insulated conductor enclosed in an insulating plastic material. The conductor is shielded by a metallic braid, and enclosed in a protective plastic jacket. Such cables often include shielding consisting generally of a plastic film/foil laminate or multiple layers thereof. In some cases the laminate is bonded using a bonding agent which may be activated by heat or other means to the insulating material of the central conductor and/or to the outer jacket.

In the telecommunications cables for the transmission of television and similar high frequency signals, it is essential to shield such signals from losses occurring due to radiation, which reduce signal strength and also may cause interference to nearby electronic apparatus. Furthermore, it is necessary to protect the signal from external electromechanical interference, and radio frequency interference (EMI and RFI). Consequently, such conductors must be shielded. This has been done, where requirements are not stringent, by employing a braided return conductor or shield of copper or aluminum wire, but because of the openings in the braid, such shielding is not completely effective, even if multiple braids are employed. Furthermore, the cable may become stiff, hard to handle, and excessively costly and heavy.

This has led to the wrapping of the cable core with a metallic foil layer, either helically or longitudinally. While this provides better shielding, especially in conjunction with a surrounding metallic braid, foil by itself is nearly impossible to apply satisfactorily unless excessively thick, which in turn results in undue stiffness, unwanted weight and added cost in the cable. In turn, foil of a thinner gauge requires a support layer of non-conducting film laminated thereon to provide structural strength in application and service.

To further improve the shielding capability, a triple laminate of foil/plastic film/foil has been employed which reduces losses and interference, and also acts as a fail-safe in the situation of cracking of one of the foil layers when the cable is flexed in installation and operation. However, unless the foil layers are connected electrically, signal loss can occur through the "slot" created by the plastic film layer.

Attempts to alleviate the above problems have been recorded by Kincaid (U.S. Pat. No. 4,406,914 Sept. 27, 1983) in which the foil layer is laminated to the plastic film layer, following which the laminate is slit and then folded at one edge resulting in a quadruple laminate of foil/plastic/plastic/foil. Wilkenloh (U.S. Pat. No. 4,117,260 Sept. 26, 1978) teaches a foil/film/foil laminate which when wrapped around the cable core provides 720° electrically continuous coverage but still does not provide true circumferential continuity and fully eliminate the "slot effect".

SUMMARY OF THE INVENTION

It is one object of the present invention to provide an improved construction of shielding tape for use in telecommunications cables, the tape being of a simple and inexpensive construction and yet providing a very effective shield and a cable incorporating such a shield.

According to a first aspect of the invention, therefore, there is provided a shielding tape for a telecommunications cable comprising a continuous longitudinally extending central inner core formed of a non-conducting material and defining a thin body substantially equal to the width of the tape, and a continuously longitudinally extending conducting material layer, the conducting material layer extending around the inner core so that, in a direction transverse to the length of the tape, it extends continuously from one edge of the conducting material layer at a position on one flat surface of the core around one of the edges of the core, across the opposed flat surface of the core, around the other of the edge of the core to an opposed edge of the conducting material layer at a position on said one flat surface of the core overlapping with said one edge of the conducting material layer.

The invention also provides a cable including one or more insulated conductors with the above tape wrapped therearound and an exterior surrounding jacket.

In most cases the conducting material layer will comprise a metallic foil of for example 0.00035 inches, but in other situations, a conducting polymeric material may be suitable.

Preferably in the present application the tape is formed from an initial laminate of a layer of the metal foil and a layer of the non-conducting or dielectric material with the edges of the layers coincident. Each edge of the tape is then folded with the dielectric material innermost to overlap along one side of the tape. In this case therefore the core is formed by two layers of dielectric material which are immediately adjacent and folded back upon one another and the foil is wrapped around the whole of the core as previously defined.

Preferably the dielectric material is of a type which is bondable to itself by application of a heat treatment or by other techniques so that the core forms an integral bonded structure by the folding step followed by the bonding step which acts to bond two layers of the dielectric material together. For this purpose various polymeric materials can be used as the dielectric material including polyethylene, polyester or polypropylene.

The bonding of the polymeric layer to the foil can be effected by any suitable technique well known to those skilled in the art.

In an arrangement in which the slot free effect is failsafe, an additional narrow fold along one edge of the initial laminate may be provided with the foil outermost so that when that edge is folded back and overlapped over the other folded edge the foil contacts the foil of the other folded edge. In the event that the foil at one edge of the tape then fails due to mechanical rupture, this additional metal to metal contact prevents a "slot" or radiation path being generated through the dielectric layer.

In some cases the folded tape can remain unbonded with a central core thus being constituted by two separate but contacting layers of the non-conducting material and the core held together by the mechanical forces of the folding. Such a tape can be readily wrapped around the conductor in the cable formation process since it can flex due to internal movement between the layers. The overlap is preferably arranged inwardly facing toward the conductor since it is thus protected with less possibility of the edges becoming disturbed or distorted.

A cable employing such a tape construction uses a tape in a width greater than the circumference of the cable core so the tape overlaps itself when applied thereto. This overlap serves to establish and confirm the circumferential continuity of the shield and eliminates the "slot-effect".

It is one advantage of the embodiments of the invention therefore that there is provided an improved shielding tape which is lighter in weight, more economical and more easily formed into the finished cable.

In a further option, a bonding layer can be applied on one exposed surface of the foil layer, preferably on the overlapping fold side, which will adhere the tape to the cable core in the cable construction. This ensures that the tape does not move on the core during flexing of the cable which can interfere with proper connection of the tape to an end terminal. The bonding layer is disposed on the surface of the conducting layer or foil in such a manner that it does not interfere with electrical continuity of the conducting layer when the tape is formed around the cable core and overlapped. Thus the bonding layer cannot cover the overlap portion to interfere with the electrical connection at the overlap. also be included herein.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

In all of the figures of the drawings, dimensions have been grossly exaggerated for the sake of clarity and in some cases adhesive for the purpose of laminating a conducting layer or layers to a dielectric film has intentionally been omitted, again for the sake of clarity.

Figure 1:
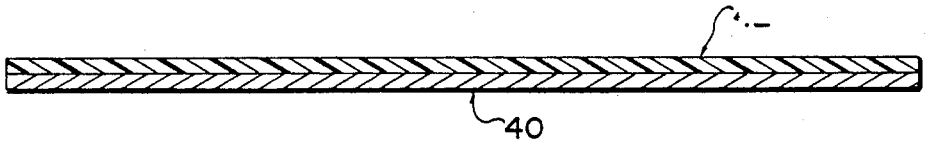
FIG. 1 is a transverse cross section of an initial laminate for forming a tape according to the invention.

Referring firstly to FIG. 1 there is shown a laminate of a conducting layer preferably a metallic foil layer 40, and a non-conducting or dielectric layer 42. The foil layer is a single layer of a thin foil for example 0.00035 inch aluminum which is of sufficient thickness to provide the necessary electrical characteristics. The laminating or bonding of the dielectric layer 42 to the foil layer 40 is not shown. The dielectric layer 42 is formed of a suitable plastics material which has sufficient structural strength to provide the tape with enough strength to undergo the necessary handling in the conventional packaging and wrapping processes. In one example the layer 42 may be polyethylene having a thickness of the order of 0.0004 inches.

The basic laminate of FIG. 1 is slit from a wide web of material into a plurality of separate tapes which are processed as hereinafter described.

Figure 3:
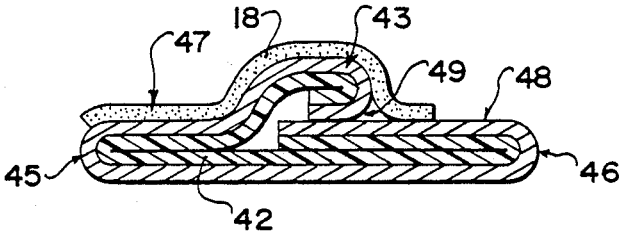
FIG. 3 is a yet further transverse cross sectional view after formation of the laminate of FIG. 2 into the tape according to the invention.

In an initial step for manufacturing a finished tape of FIG. 3, a narrow fold is formed at one edge indicated at 43 of the tape, the narrow fold being substantially of the minimum dimension necessary to define a stable folded edge in which the foil layer 40 extends around the outer periphery of the fold to define a piece 44 along an upper edge of the tape.

Figure 2:
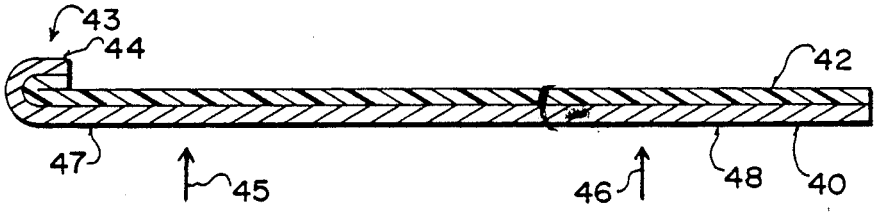
FIG. 2 is a similar transverse cross section of a laminate of FIG. 1 after completion of an initial step in the manufacture of the tape according to the invention.

In a second step, each edge of the tape of FIG. 2 is then folded at a point approximately $\frac{1}{4}$ of the distance from the edge across the tape, each of the fold points being indicated in FIG. 2 at the arrows 45 and 46. Thus the tape construction is formed as shown in FIG. 3 in which the fold points 45 and 46 now define outer edges of the tape with the parts 47 add 48 of the tape as shown in FIG. 2 now lying as shown back along the upper side of the tape to an overlap position at a midpoint of the upper side. The portion 48 lies beneath the portion 47 so that the fold 43 is on the outer side and can engage the foil layer of the portion 48 as indicated at 49.

Subsequent to the folding a heat treatment is applied to the folded tape so as to generate sufficient heat at the contact between the engaging surfaces of the layer 42 to provide a heat actuated bond therebetween. In this way the layer 42 forms effectively a central core of the tape in the finished structure of FIG. 3 with the central core forming a thin flat band across substantially the full width of the tape wrapped therearound by the foil layer which fully encloses the central core and overlaps at the upper surface of the tape, as shown in FIG. 3. An additional bonding layer 18 can optionally be applied to the tape on the folded surface as indicated at FIG. 3 extending from the edge 45 over the overlap to a position spaced from the edge 46. This bonding layer acts as a bonding agent in the finished cable as shown in FIG. 7.

Figure 4:
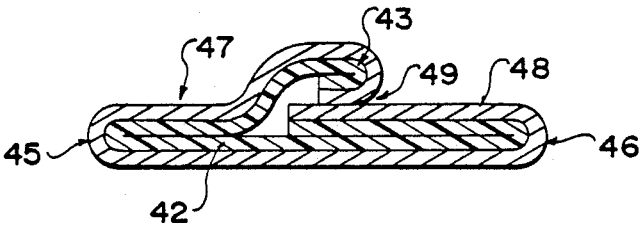
FIG. 4 is a view similar to that of FIG. 3 in which the bonding layer 18 is omitted.

The structure shown FIG. 4 is identical to that of FIG. 3 except that the bonding layer 18 is omitted for use in an "unbonded" cable structure or for use in an arrangement in which the bonding layer is applied to the central core of the cable.

Figure 5:
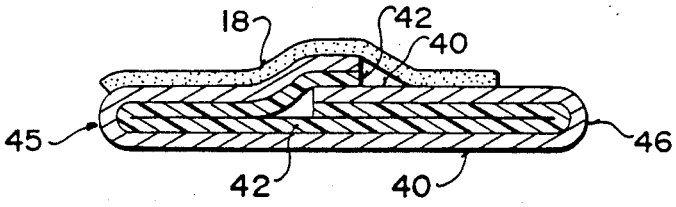
FIG. 5 is a similar transverse cross sectional view of the laminate of FIG. 1 formed into a tape according to the invention.
Figure 6:
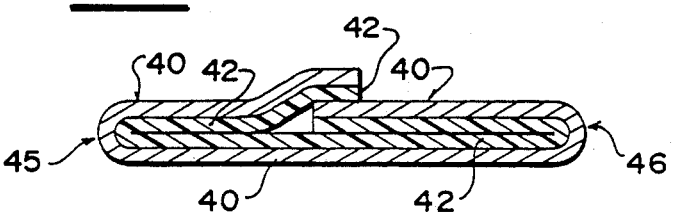
FIG. 6 is a view similar to that of FIG. 5 in which the bonding layer 18 is omitted.

The structures shown in FIG. 5 and 6 are substantially identical to those of FIGS. 3 and 4 respectively except that the fold 43 is omitted. In this case, at the overlap, the layer 42 contacts the foil layer 4 and thus there is no electrical contact between the foil layers at the point. However in the use of the tape the foil layer at the edges 45 and 46 acts to prevent the generation of any "slot effect" except in the rare circumstance where breakdown of the foil a that point occurs due to mechanical handling.

Figure 7:
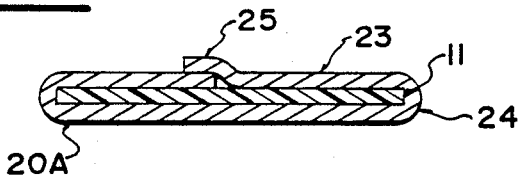
FIG. 7 is a transverse cross section of a further tape according to the present invention.

In FIG. 7 there is illustrated a further embodiment of the subject tape. In this embodiment a plastic film layer 11 is enfolded by a conducting layer 24 which is slightly wider than twice the width of the film 11. Again the folding takes place at points approximately ¼ of the distance from the respective edge. The layer 24 is laminated with the film layer 11 and on the upper surface overlap indicated at 25 there is provided perimetric continuity of the layer 24 which completes the encapsulation of the film 11. In this case, similarly to that of FIG. 3 there is provided the slot free effect even upon failure of one edge of the foil.

The structure of FIG. 7 is formed by bringing together a tape of the film and tape of the foil, laminating the foil to the film and enfolding the foil around the edges of the film to take up the construction shown.

Figure 8:
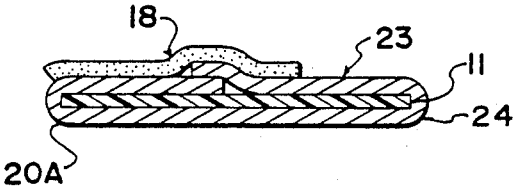
FIG. 8 is a cross sectional view of a further embodiment of tape of the type similar to that of FIG. 3 and incorporating an additional bonding layer 18.

In FIG. 8 there is shown a similar construction to that of FIG. 5 with the addition of an offset bondable layer 18 which may be activated after forming around the cable cord during the jacket extrusion process, thus bonding the tape to the core and facilitating termination.

Figure 9:
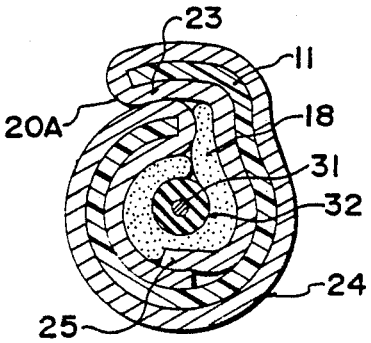
FIG. 9 illustrates a typical application to a single conductor coaxial cable of the tape of the type shown in FIG. 3.

FIG. 9 illustrates a typical example to a single conductor coaxial cable incorporating one of the tapes described in FIGS. 3 to 8 above. For convenience of illustration, the cable incorporates the tape depicted in FIG. 3. Thus the conductor 31 is surrounded by insulation 32 around which is formed the tape. Overlap 43 of the conducting layer 40 overlaps the opposed edge of the tape providing perimetric continuity of the shield. The bondable layer 18 bonds the tape to the insulation 32 providing ease of attachment of the terminal assemblies and adds to the structural qualities of the cable.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A shielding tape for telecommunication cables comprising an elongate tape body having a width transverse to a longitudinal axis less than a length longitudinal thereof and including a continuous longitudinally extending central inner core formed of a non-conducting material and defining a thin body substantially equal to the width of the tape body having two side edges, a first flat surface and a second opposed flat surface, and a conducting material layer which extends continuously longitudinally of the core and extends transversely from a first side edge of the conducting material layer to a second side edge thereof, the conducting material layer being wrapped around the inner core so that, in a direction transverse to the length of the tape, the conducting material layer extends continuously from said first side edge of the conducting material layer which lies at a position on said first flat surface of the core, around one of the side edges of the core, across said second opposed flat surface of the core, around the other of the side edges of the core to said second side edge of the conducting material layer which lies at a position on said first flat surface of the core, with said second side edge of the conducting material layer overlapping said first side edge of the conducting material layer.

2. The invention according to claim 1 wherein the tape body is formed from a laminate of the conducting material layer and non-conducting material with side edges of the conducting material layer directly overlying side edges of the non-conducting material, said laminate being folded longitudinally to form a first and a second folded portions each of which lies back along one side of the tape body with the first portion overlapping the second portion outwardly thereof on that one side so that said central core is formed by two layers of the non-conducting material with the conducting material layer wrapped therearound.

3. The invention according to claim 2 wherein the two layers of the non-conducting material forming the central core are bonded together.

4. The invention according to claim 2 wherein an edge portion of the first folded portion is folded along the length thereof to provide electrical contact with said second folded portion at the overlap therewith.

5. A shielding tape for telecommunication cables comprising a tape body having one flat surface and an opposed flat surface, the tape body being formed from a conducting material layer and a non-conducting material layer laminated to form a longitudinally extending base tape with side edges of the conducting material layer directly overlying side edges of the non-conductive material layer, the base tape being folded longitudinally about a first fold line to form a first folded portion with the conducting material layer outermost and folded longitudinally about a second fold line spaced from the first fold line by a distance slightly less than one half of the width of the base tape to form a second folded portion with the conducting material layer outermost, the first folded portion overlapping the second folded portion on said one flat surface of said tape body, whereby the conducting material layer extends continuously from said one flat surface of the tape body around the first fold line, across said opposed flat surface of the tape body, around the second fold line to said one flat surface of the tape body with an overlapping portion on said one flat surface.

6. The invention according to claim 5 wherein the two layers of the non-conducting material layer formed by the folds are bonded together.

7. The invention according to claim 5 wherein the first folded portion is folded longitudinally at a third fold adjacent one edge of the base tape with the conducting material layer outermost to provide electrical contact with the second folded portion of the tape body at the overlap therewith.

8. A shielded CATV cable comprising a core having a longitudinally extending conductor and insulation surrounding the conductor and a shielding tape wrapped around the insulation and comprising an elongate tape body having a width transverse to a longitudinal axis less than a length longitudinal thereof and including a continuous longitudinally extending central inner core formed of a non-conducting material and defining a thin body substantially equal to the width of the tape body having two side edges, a first flat surface and a second opposed flat surface, and a conducting material layer which extends continuously longitudinally of the core and extends transversely from a first side edge of the conducting material layer to a second side edge thereof, the conducting material layer being wrapped around the inner core so that, in a direction transverse to the length of the tape, the conducting material layer extends continuously from said first side edge of the conducting material layer which lies at a position on said first flat surface of the core, around one of the side edges of the core, across said second opposed flat surface of the core, around the other of the side edges of the core to said second side edge of the conducting material layer which lies at a position on said first flat surface of the core, with said second side edge of the conducting material layer overlapping said first side edge of the conducting material layer.

9. The invention according to claim 8 wherein the tape body is formed from a laminate of the conducting material layer and non-conducting material with side edges of the conducting material layer directly overlying side edges of the non-conducting material, said laminate being folded longitudinally to form a first and a second folded portions each of which lies back along one side of the tape body with the first portion overlapping the second portion outwardly thereof on that one side so that said central core is formed by two layers of the non-conducting material with the conducting material layer wrapped therearound.

10. The invention according to claim 9 wherein the two layers of the non-conducting material forming the central core are bonded together.

11. The invention according to claim 10 wherein an edge portion of the first folded portion is folded along the length thereof to provide electrical contact with said second folded portion at the overlap therewith.

12. A shielded CATV cable comprising a core having a single longitudinal conductor and insulation surrounding the conductor, and a shielding tape wrapped around the insulation, the shielding tape comprising a conducting material layer and a non-conducting material layer laminated to form a longitudinally extending base tape with side edges of the conducting material layer directly overlying side edges of the non-conductive material layer, the base tape being folded longitudinally about a first fold line to form a first folded portion with the conducting material layer outermost and folded longitudinally about a second fold line spaced from the first fold line by a distance slightly less than one half of the width of the base tape to form a second folded portion with the conducting material layer outermost, the first folded portion overlapping the second folded portion on said one flat surface of said tape body, whereby the conducting material layer extends continuously from said one flat surface of the tape body around the first fold line, across said opposed flat surface of the tape body, around the second fold line to said one flat surface of the tape body with an overlapping portion on said one flat surface.

13. The invention according to claim 12 wherein the two layers of the non-conducting material layer formed by the folds are bonded together.

14. The invention according to claim 12 wherein the first folded portion is folded longitudinally at a third fold line adjacent one edge of the base tape with the conducting material layer outermost to provide electrical contact with the second folded portion of the tape body at the overlap therewith.

* * * * *